United States Patent [19]

Weigl

[11] 4,251,090

[45] Feb. 17, 1981

[54] SAFETY SKI BINDING

[75] Inventor: Erwin Weigl, Brunn am Gebirge, Austria

[73] Assignee: TMC Corporation, Baar/Zug, Switzerland

[21] Appl. No.: 1,364

[22] Filed: Jan. 5, 1979

[30] Foreign Application Priority Data

Jan. 5, 1978 [AT] Austria ..... 72/78

[51] Int. Cl.[3] ..... A63C 9/086

[52] U.S. Cl. ..... 280/618; 280/611

[58] Field of Search ..... 280/618, 617, 611

[56] References Cited

U.S. PATENT DOCUMENTS

| | | | |
|---|---|---|---|
| 3,797,839 | 3/1974 | Smolka | 280/617 |
| 3,797,844 | 3/1974 | Smolka | 280/617 |
| 3,813,109 | 5/1974 | Salomon | 280/618 |
| 4,095,814 | 6/1978 | Weigl | 280/618 |
| 4,098,522 | 7/1978 | Beyl | 280/618 |

FOREIGN PATENT DOCUMENTS

| | | |
|---|---|---|
| 299030 | 10/1970 | Austria . |
| 326015 | 11/1975 | Austria . |
| 330632 | 7/1976 | Austria . |
| 2324078 | 11/1974 | Fed. Rep. of Germany . |

*Primary Examiner*—John J. Love
*Assistant Examiner*—D. W. Underwood
*Attorney, Agent, or Firm*—Blanchard, Flynn, Thiel, Boutell & Tanis

[57] ABSTRACT

A sole plate construction for a ski. The sole plate is pivotally secured to the ski about a centrally located pivot axis with respect to the sole plate. Front and rear holding parts are provided on the ski to hold the sole plate in a fixed position relative to the ski during a normal downhill skiing position of use. One of the holding parts incorporates a locking element which yieldingly holds the sole plate in a longitudinally aligned relationship relative to the ski. In order to minimize the number of fastening elements required to hold the components to the ski, the holding parts are secured to centering plates, each of which has an elongated slot therein receiving the pivotal support part pivotally holding the sole plate to the ski. Any flexing of the ski will cause the centering plates to shift with respect to one another and to the pivotal support part. A single fastening element serves to secure each centering plate to the ski.

13 Claims, 4 Drawing Figures

1
1a
2
2a
2b
2c
3
3a
3b
4
5
6
6a
6b
6c
6d
7
8
8a
9
9a
10
I

SAFETY SKI BINDING

FIELD OF THE INVENTION

A safety ski binding comprising a sole plate for receiving a ski boot, which sole plate engages with each of its two ends a ski-fixed holding part, is held against rotation by a spring-loaded locking mechanism, and is rotatably supported approximately in its center about a ski-fixed, vertical pivotal support part and is simultaneously secured also against release from said ski.

BACKGROUND OF THE INVENTION

A rotatably supported sole plate of the above-mentioned type is described for example in German OS No. 2 324 078. In this known construction, the sole plate consists of a base plate on the ski and a plate on the boot side. The space between the plates is protected against external influences by an expandable sleeve. The connection between the two plates is created by a bearing, the vertical pivot axis of which extends through the shin-bone axis and the horizontal pivot axis of which extends transversely with respect to the longitudinal axis of the ski in a plane of the vertical axis. The vertical support is constructed as a ball bearing for reducing friction, while the horizontal support consists of a sliding bearing made of bolts and tetrapolyethylene fluoride sleeves.

The foregoing described construction of the known apparatus permits at the same time to recognize the first disadvantage of this solution, namely, the use of many structural parts and the plate also has to have a special design. The use of many structural parts is not only expensive, also the number of tolerance errors increase and the frictional forces which are to be overcome increase. A further disadvantage consists in the structural parts which determine the position of the vertical pivotal support part not permitting any play for receiving of compression forces, which are created by a bending of the ski, for example during travel over a depression. Furthermore it is absolutely necessary that the plate be permitted to pivot about an additional horizontal axis.

It is also known according to Austrian Pat. No. 330 632, to use one single pin or pivotal support part which permits the sole plate to both be pivoted through a limited range in the horizontal and also in the vertical plane, before a release operation takes place. The pivotal support part serves substantially for centering and positioning of the sole plate.

From Austrian Pat. No. 299 030 it is already known to compensate for the bending of the ski by rigidly connecting the sole plate to the ski through a single fastening point. This construction, however, does not permit a pivoting of the sole plate with respect to the ski, so that a spring-loaded locking mechanism cannot be used, which could control the release operations during a twisting fall and partly during a fall wherein simultaneous upward and sideward forces are applied to the binding, as this is for example possible in the aforementioned construction according to Austrian Pat. No. 330 632 and also is to be realized in the case of the subject matter of the invention. For a similar reason, it is also not possible to use the solution according to Austrian Pat. No. 302 130, in which the sole plate is held between two spaced bearing points from the upper side of the ski.

In order to be complete, reference is also made to Austrian Pat. No. 326 015, in which a sole plate is pivotally supported about a pivotal support part and rotatably with respect to a spring-loading locking mechanism in the downhill skiing position. This known solution does not exceed the state of the art which is described in Austrian Pat. No. 330 632 and is already discussed above.

Finally it is also mentioned that various plate mountings made of a relatively thin sheet metal material are known on the market, which have grooves therein, which facilitate an adjustment of these plates to bent skis. Since these plates are constructed necessarily thin, the individual parts are moved into one another, which results in an undesired accumulation of material and results in a constant change of the shape of the plates. Therefore, such a construction could not be successful on the market. Also an attempt was made to construct the plate which is supported on a ski-fixed part with two slots which are arranged substantially transversely with respect to the longitudinal axis of the ski and are each arranged spaced from the pivotal support part, in order to form for the accumulated material nominal receiving points. This construction again has a disadvantage namely the bent areas are created automatically in the slot areas where the material thickness is the least with reference ot the width of the plate and thus breakage of the plate can easily occur. This in particular because the tapered points serve as rests for the entire weight of the skier, since the ski supports the plate along these tapered portions. Similar situations also exist when the grooves are provided extending inwardly from the two sides and the connection is formed by connecting pieces which exist centrally with respect to the longitudinal axis of the ski.

The objects of the invention are to avoid the aforementioned problems and further disadvantages of the known constructions and to provide a sole plate of the above-mentioned type as insensitive as possible also with respect to a bending of the ski. Since furthermore each screw hole in a ski weakens the ski, it is possible to secure the sole plate or its two holding parts to the upper side of the ski with as few screws as possible.

The set objects are inventively attained by the pivot part and the two ski-fixed holding parts of the sole plate being screwed to the ski each with only one screw arranged on longitudinal axis of the ski, and the individual holding parts are each fixedly connected to one centering plate, which centering plates permit a reciprocal shifting upon a bending of the ski by the provision of one elongated hole in each centering plate and which is associated with the pivot part and forms together with the pivot part an enlarged head received in a blind hole of the sole plate, which opens upwardly and limits the vertical movement of the ski relative to the sole plate.

The two-part construction of the centering mechanism enables a deformation-free compensation for a change in length of the ski occurring during a bending thereof. The pivotal support part and the blind hole are thereby inventively constructed so that they permit the sole plate to be positioned during bending of the ski on a chord with respect to an arc defined by the ski.

BRIEF DESCRIPTION OF THE DRAWINGS

Further details, advantages and characteristics of the invention will be described more in detail with reference to the drawing, which illustrates one exemplary embodiment and in which.

DETAILED DESCRIPTION

The type of fastening of the ski boot on the sole plate, the construction of the locking mechanism and the support of the sole plate through the use of a profiled holding piece are actually known and are not part of the subject matter of the present invention. (See U.S. Pat. No. 4,033,462). Therefore, these parts are neither illustrated in FIGS. 2 and 3, nor are they described in detail in this detailed description.

Figures 1, 2, 3:
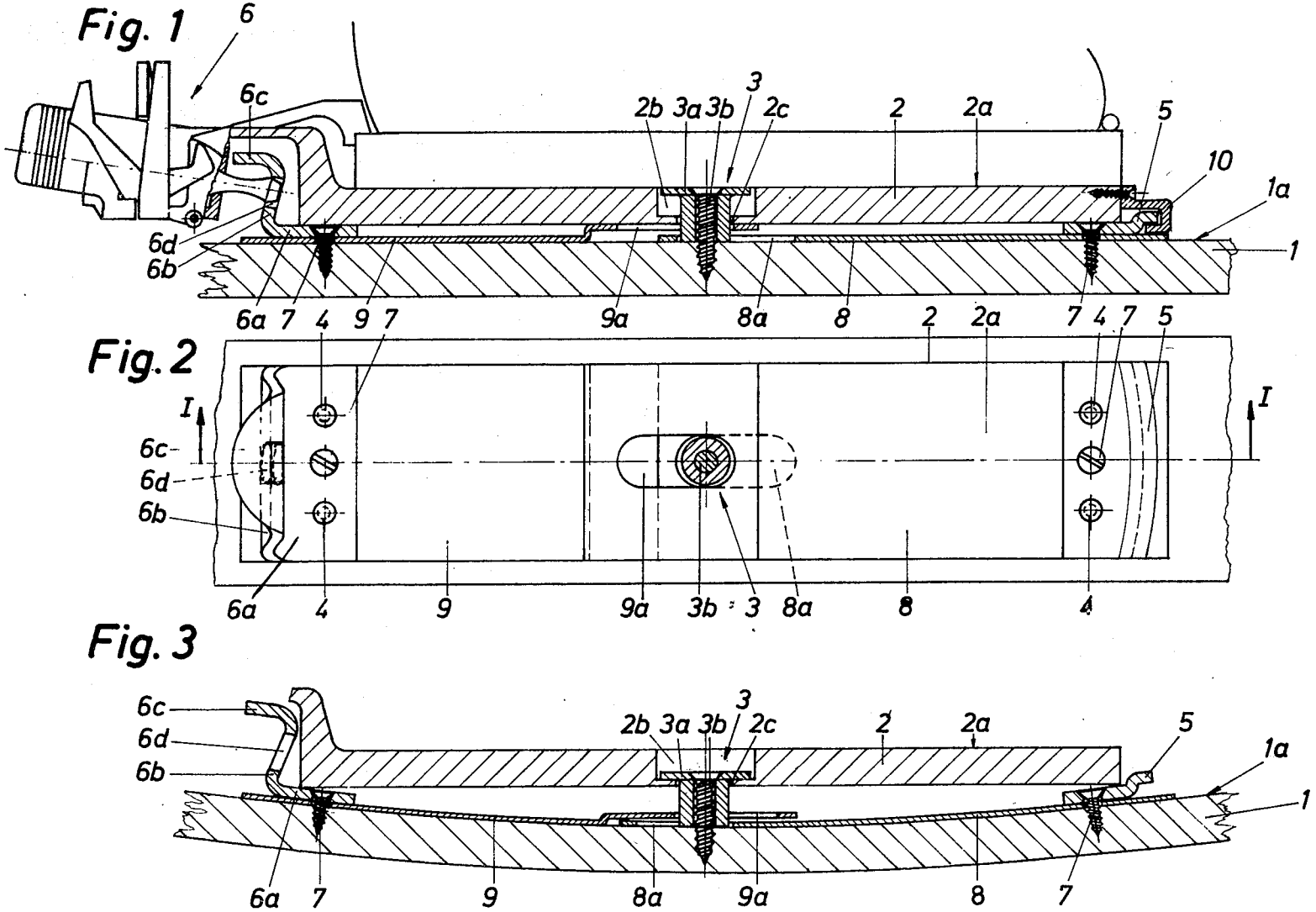
FIG. 1 is a side view of the inventive sole plate, the spring-loaded locking mechanism and the angular holding profile, partially sectioned along the line I—I of FIG. 2.
FIG. 2 is a top view of FIG. 1 with a common centering mechanism for the locking parts and omitting the sole plate.
FIG. 3 illustrates in cross section the position of the sole plate and the remaining structural parts during a bending of the ski, otherwise approximately according to FIG. 1.

FIG. 1 illustrates a sole plate 2 which is pivotally mounted on a partially illustrated ski 1, which has a locking mechanism 6 at its rear end and a profiled holding piece 10 at its front end. The sole plate 2 which is designed substantially rectangularly in shape has over its length which extends parallel with respect to the upper side of the ski a uniform thickness and, approximately in the center of the sole plate 2, there is provided on the upper side 2*a* thereof an upwardly opening blind hole 2*b*. An opening 2*c* concentric with the opening 2*b* is provided in the bottom of the blind hole 2*b*, the diameter of which is approximately half the size of the diameter of the blind hole 2*b*.

The opening 2*c* receives a pivotal support part 3 therein. The axis of the pivotal support part 3 which extends perpendicularly to the upper surface 1*a* of the ski has a flat enlarged head 3*a* at its end remote from the ski 1. The pivotal support part 3 is designed so that the upper surface of the head 3*a* is generally flush with the upper surface 2*a* of the sole plate in the normal position of use (downhill skiing position) thereof, namely when the ski 1 is not deformed by an external force applied thereto. The diameter of the pivotal support part 3 and of its flat head 3*a* are designed slightly smaller than the diameter of the opening 2*c* or of the blind hole 2*b*, in order to permit a relative movement between the pivotal support part 3 and the sole plate 2, which movement will be yet described more in detail hereinbelow. The pivotal support part 3 has an opening therethrough which is concentric with respect to the longitudinal axis of the pivotal support part, which opening has a countersunk surface at the end remote from the ski 1, in order to be able to receive therein a flat-head screw 3*b* which is connected to the ski.

The sole plate 2 rests with its ends on a front sole plate holding part 5 and a rear sole plate holding part 6*a*. Each sole plate holding part 5, 6*a* is appropriately positioned by the interpositioning of a centering device 8, 9 on the upper surface 1*a* of the ski 1. More specifically, the centering device is composed of a front centering plate 8 and a rear centering plate 9. In addition, rivets 4 connect the centering plate 8 to the front sole plate holding part 5 and the centering plate 9 to the rear sole plate holding part 6*a*. The rear sole plate holding part 6*a* has two bent sections 6*b* and 6*c*. The bent section 6*b* extends upwardly and rearwardly from the rear sole plate holding part 6*a*. The lateral edge of the first bent section 6*b* of the rear sole plate holding part 6*a* converge in the upward direction toward the second bent section 6*c* which extends generally horizontally. The bent section 6*b* has an opening 6*d* approximately in its center, which opening serves to receive a mushroom-like locking element of the spring-loaded locking mechanism 6. The release operations are controlled by this locking mechansim during twisting falls and partially during falls wherein the binding is subjected to simultaneously applied upward and sideward forces.

As will be recognized from FIG. 2, the outline of the rear edge of the second bent section 6*c* of the rear sole plate holding part 6*a* is circularly constructed. The rear sole plate holding part 6*a* extends upwardly in the region of its two bent sections 6*b*, 6*c* to a height wherein the upper surface of the bent section 6*c* is approximately twice the thickness of the plate 2. The front sole plate holding part 5 which is connected to the centering plate 8 by means of rivets 4 has a doubly bent member generally defining an S-shaped member. The front edge of the front sole plate holding part 5 is provided with a radius which is as large as the spacing between the holding part 5 and the central axis of the pivotal support part 3, so that in spite of an interfitting relation, it is assured that the angled holding profile 10 which grips over the holding part 5 and is fixedly connected to the plate 2 will pivot with the sole plate about the axis of the pivotal support part 3. The sole plate holding part 5 has an overall height which is approximately twice the thickness of the material thereof. Both sole plate holding parts 5, 6*a* are designed as wide as the plate 2.

In order to be able to mount each of the sole plate holding parts 5, 6*a* with only one flat-head screw 7 each, however, still prevent a rotation thereof about an axis perpendicular to the longitudinal axis of the ski, the centering plates 8 and 9 are used for centering. The screws 7 are received in the aligned openings in the centering plates 8 and 9 and on the central longitudinal axis of the ski and in the sole plate holding parts 5, 6*a*.

Each of the two centering plates 8, 9 is designed longer than half of the total length of the plate 2. The centering plates are riveted to the sole plate holding parts 5, 6*a* so that the longitudinal ends thereof project beyond the ends of the sole plate holding parts 5, 6*a*. The other ends of each of the centering plates 8, 9 project slightly beyond the region of the pivotal support part 3 and overlap. In order to make possible the thus created overlapping of the two centering plates 8 or 9, the centering plate 9 is bent twice, approximately at a right angle in both places and overlaps part of the centering plate 8. Furthermore, each centering plate 8, 9 has an elongated hole 8*a* and 9*a*, respectively, which extends parallel to the longitudinal axis of the ski. The elongated hole 8*a* is provided in the front centering plate 8 and the elongated hole 9*a* is provided in the rear centering plate 9.

The two elongated holes 8*a*, 9*a* are constructed in the associated centering plates 8, 9 so that the pivotal support part 3 almost engages in the normal position of use according to FIGS. 1 and 2 (downhill skiing position) of the mutually adjacent ends of the two elongated holes 8*a*, 9*a*.

FIG. 3 illustrates the ski during an externally applied force causing the ski to flex. The ski is bent such that the centering plates 8 and 9 define a chord of the arced ski 1. The centering plates 8 and 9 are thus both moved in direction toward the pivotal support part 3. This movement is made possible only through the two, already more in detail described elongated holes 8*a* and 9*a*.

The sole plate 2 forms, as stated above, the chord for an arc described by the ski. The sole plate 2 is secured against loss by the enlarged head 3*a* of the pivotal support part 3, which permits the sole plate 2 to be lifted from the ski 1 at least in the region of its longitudinal center and permits a compensation of the bending of the ski 1, until the bottom of the blind hole 2*b* engages the lower surface of the enlarged head 3*a* of the pivotal support part 3.

Figure 4:
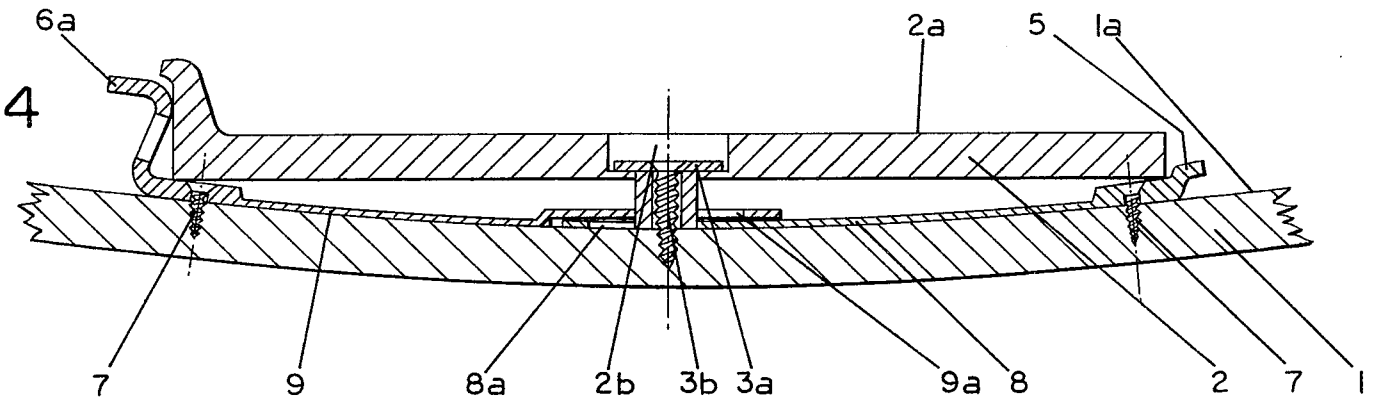
FIG. 4 illustrates in cross section front and rear holding parts constructed in one piece with the respective front and rear centering plates.

The invention is not limited to the illustrated exemplary embodiment. Various modifications are conceivable, which lie by all means within the scope of the invention. For example, at least one or both of the centering plates can consist of a thin sheet material and are superposed in the region of the pivotal support part. However, it is also possible to construct the front and/or the rear holding part(s) in one piece with the associated centering plate as shown in FIG. 4.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defind as follows:

1. In a safety ski binding comprising a sole plate pivotally connected to said ski about a vertical axis located approximately in the center thereof and adapted to receive a ski boot thereon, the longitudinal ends of said sole plate each engaging a ski-fixed holding part, a spring-loaded locking mechanism for holding said sole plate against rotation, said vertical axis being defined by an upstanding pivotal support part secured to said ski and including means for preventing a release of said sole plate from said ski, the improvement comprising wherein said pivotal support part and the two ski-fixed holding parts for said sole plate are each secured to said ski by only one fastening member arranged on the longitudinal axis of said ski, wherein said individual holding parts are each fixedly connected to a separate centering plate which permit a reciprocal longitudinal shifting therebetween during a bending of said ski, each centering plate having an elongated hole therein encircling said pivotal support part and forming together with said pivotal support part a centering mechansim, wherein said pivotal support part has an enlarged head received in a countersunk hole in said sole plate, which countersunk hole opens uupwardly and serves to limit the amount of vertical movement of said sole plate relative to said ski.

2. The improved binding according to claim 1, wherein said two ski-fixed holding parts are located relative to said pivotal support so that, when said ski is bent, said sole plate engaged therewith extends on a chord of the arc of said bent ski, said enlarged head of said pivotal support moving relative to the bottom of said countersunk hole to limit the magnitude of the arc of said ski, whereat the material of said ski is elongated adjacent the bottom surface of said ski and is compressed adjacent the upper side thereof and said two centering plates are moved simultaneously toward one another.

3. The improved binding according to claim 1 or 2, wherein said enlarged head and said pivotal support part are positioned with clearance in the associated countersunk hole, which clearances permit a relative movement between said pivotal support part and said sole plate.

4. The improved binding according to claim 1, wherein the upper end of said pivotal support part terminates in said enlarged head which is flush, in the normal position of use (downhill skiing position) with the upper surface of said sole plate.

5. The improved binding according to claim 1, wherein at least one of said centering plates is doubly bent in the vertical direction in reference to the other centering plate adjacent said pivotal support part.

6. The improved binding according to claim 1, wherein at least one of said two centering plates consists of a thin sheet metal material, wherein said thin sheet metal is arranged in the region of said pivotal support part one above the other.

7. The improved binding according to claim 1, wherein each of the front and the rear holding part is fixedly connected to the associated centering plate by two fasteners which lie spaced from one another transversely with respect to the longitudinal axis of said ski.

8. The improved binding according to claim 7, wherein said front holding part is rounded off at a radius the center of which is located at the center of said pivotal support part and is guided by an angled holding profile which is arranged on said sole plate and which facilitates a pivoting of said sole plate about the axis of said pivotal support part.

9. The improved binding according to claim 8, wherein said front holding part is doubly bent and the second bent section thereof is gripped under by said holding profile.

10. The improved binding according to claim 1, wherein said fastening member of said pivotal support part and said holding parts on said sole plate are flat-head screws, wherein said flat-head screws which are associated with said holding parts extend also through the associated centering plates.

11. The improved binding according to claim 1, wherein the vertical height of said rear holding part of said sole plate corresponds in the region of its two bent sections approximately to twice the thickness of the part of said sole plate beneath the sole of said ski boot.

12. The improved binding according to claim 1, wherein said front holding part is constructed in one piece with the front centering plate.

13. The improved binding according to claim 1 or claim 12, wherein the rear holding part is constructed in one piece with the rear centering plate.

* * * * *